US011415280B2

(12) United States Patent
Bai

(10) Patent No.: US 11,415,280 B2
(45) Date of Patent: Aug. 16, 2022

(54) CEILING LAMP

(71) Applicant: Guangdong Yueliang Technology Co., Ltd., Guangdong (CN)

(72) Inventor: Dandan Bai, Huizhou (CN)

( * ) Notice: Subject to any disclaimer, the term of this patent is extended or adjusted under 35 U.S.C. 154(b) by 0 days.

(21) Appl. No.: 17/485,449

(22) Filed: Sep. 26, 2021

(65) Prior Publication Data

US 2022/0228717 A1 Jul. 21, 2022

(30) Foreign Application Priority Data

Jan. 19, 2021 (CN) ..... 202110068020.2

(51) Int. Cl.

| | |
|---|---|
| ***F21V 33/00*** | (2006.01) |
| ***F21S 8/04*** | (2006.01) |
| ***F21V 3/10*** | (2018.01) |
| ***F21V 21/04*** | (2006.01) |
| *F21W 131/00* | (2006.01) |

(52) U.S. Cl.

CPC ..... *F21S 8/04* (2013.01); *F21V 3/10* (2018.02); *F21V 21/042* (2013.01); *F21V 33/0096* (2013.01); *F21W 2131/00* (2013.01)

(58) Field of Classification Search

CPC ..... F21S 8/03; F21S 8/04; F21S 8/033; F21V 21/042; F21V 33/0096; F21V 21/08; F21V 21/088; F21W 2131/00

See application file for complete search history.

(56) References Cited

U.S. PATENT DOCUMENTS

| | | | | |
|---|---|---|---|---|
| 4,711,161 | A * | 12/1987 | Swin, Sr | F21V 33/0088 362/96 |
| 2014/0314571 | A1* | 10/2014 | Wu | F21V 33/0096 362/96 |
| 2019/0264702 | A1* | 8/2019 | Huggins | F21V 33/0096 416/5 |

* cited by examiner

*Primary Examiner* — Y M. Quach Lee

(74) *Attorney, Agent, or Firm* — Tsz Lung Yeung

(57) ABSTRACT

The ceiling lamp includes a top plate, a ceiling shell, an air guide shell, a main shell and a lampshade. A first accommodation cavity is formed between the ceiling shell and the air guide shell. A second accommodation cavity is formed with the lampshade. An illuminant board is configured in the second accommodation cavity. A fan is configured coaxially on the axis of the air guide shell. An air passage connected with the fan is opened on the lampshade by invagination along the axial direction of the lampshade. At least one air hole is formed on air guide shell. A filter screen module is detachably configured in the air passage. The external air flow is discharged from the air hole through the fan by the filter module, or enters from the air hole and then discharges through the filter module after passing through the fan.

8 Claims, 6 Drawing Sheets

CEILING LAMP

CROSS REFERENCES OF RELATED APPLICATIONS

This application claims the benefits of Chinese Patent Application No. 202110068020.2, filed on Jan. 19, 2021, the entire contents of which are hereby incorporated by reference in this application.

BACKGROUND OF THE PRESENT INVENTION

Field of Invention

The present invention relates to ceiling lamp field, and more particularly to a ceiling lamp.

Description of Related Arts

Ceiling lamp is a very common lighting device. Ceiling lamp is a kind of lighting which is installed or embedded in the ceiling of the roof. It is also the main indoor lighting device like a chandelier. With the improvement of people's quality of life, people's demand for air quality is also higher and higher, and the ceiling lamp with the function of air purification emerge.

However, the existing ceiling lamp with the function of air purification can not achieve a good balance in the position distribution between the air purification and the main body of the ceiling lamp, it usually ignore the air filtration efficiency in order to ensure enough space for lighting part, or make the whole ceiling lamp look thick and bulky in order to combine the air filtration efficiency and enough space for lighting part. In order to make the whole structure more compact, some ceiling lamps use the way of side air intake and side air supply to reduce the whole size of the ceiling lamp, while this way is affects the air inlet efficiency and air outlet efficiency, the uniformity of air inlet and air outlet is also affected, and the overall effect of air purification is ordinary.

SUMMARY OF THE PRESENT INVENTION

For overcoming the drawing backs of the conventional ceiling lamp, the present invention provides a ceiling lamp, which solves the problem of poor balance between the function of air purification and the position distribution of lamp part, inefficient air filtration.

Accordingly, the present invention provides a ceiling lamp comprises a top plate, a ceiling shell, an air guide shell, a main shell and a lampshade which are fixedly connected from top to bottom, a first accommodation cavity is formed between the ceiling shell and the air guide shell, a power supply module and a control board is configured in the first accommodation cavity, the lampshade is arranged on the main shell to form a second accommodation cavity, a illuminant board is configured in the second accommodation cavity, a fan is configured coaxially on the axis of the air guide shell, and the middle part of the lampshade is recessed along its axial direction to form an air passage communicating with the fan, at least one air hole is formed uniformly on the air guide shell, a filter screen module is configured detachably in the air passage, the flow direction of the external is from the filter module to the fan and then discharged from the air hole, or from the air hole to the fan and then discharged through the filter module.

In the above-mentioned implementation process, the present invention provides a ceiling lamp, which has both lighting function and purification function, the filter screen module, which play the main purification role is arranged in the middle, the filter screen module can evenly inhale air from multiple angle, and then purify and discharge it, which purification coverage is wide and uniform. The air inlet and the air outlet are arranged in layers and connected with each other through the fan, which maximizes the air intake and air outlet, and improve filtration efficiency. The lampshade sinks in to form an air passage, the filter screen module is arranged in the air passage, no matter how the air flow direction is, air can enter the ceiling lamp or discharge out of the lamp only through the filtering effect of the filter screen module. It can be seen that the present invention orderly and compactly arranges the filter screen module and other lighting related parts of the ceiling lamp through reasonable location, so as to achieve the maximum benefit coexistence between the lighting function and the filtering and purification function, under the premise of not affecting the normal lighting function, it can ensure the maximum filtration and purification effect.

Preferably, the ceiling shell is concaved to form a first tank for accommodating the top plate, a set of adaptive rotating buckle structure is configured respectively in the inner wall of the first tank and the circumference of the top plate, the ceiling shell is rotationally clamped to the top plate by the rotating buckle structure.

In the above-mentioned implementation process, the people can fix the top plate on the ceiling or wall, then misplace the first block with the clamping tank, insert the first tank into the top plate, insert the top plate into the first tank, and then rotate in a directional direction, and the rotating buckle structure completes the fixed connection in the process of rotation.

Preferably, a set of electric clamping structure is configured on the ceiling shell and the top plate, the electric clamping structure comprises a first clamping block extended to form a plurality of arc-shaped clamping edges and a clamping tank matched with the clamping edge, a set of adaptive conductive part is configured on the clamping edge and clamping tank, the clamping edge is clamped into the clamping tank and the top plate is electrically connected with the fixed plate when the rotating buckle structure is clamped in place.

In the above-mentioned implementation process, the rotating buckle structure completes the fixed connection in the rotation process, at the same time, the clamping edge on the first clamping block is also clamped into the clamping tank in the rotation process, and the conductive part on the clamping edge contacts with the conductive part in the clamping tank to complete the electrical connection.

In above-mentioned solution, not only the ceiling lamp is fixed, but also its electrical conduction is completed by rotating buckle structure, there is no need to connect other wires, so the installation is convenient and fast, and the subsequent disassembly and replacement is also very convenient, which improves the user experience, in addition, the rotating buckle structure is set at the periphery, while the electric clamping structure is set at the inner circumference, the two cooperate with each other, which makes the overall connection structure more stable and firm, the distribution of stress points is uniform, and the safety performance after connection is higher.

Preferably, a second tank is formed around the first tank on the side of the ceiling shell facing away from the top plate, the second tank is annular, the power supply module and the control board is configured in the second tank.

In the above-mentioned implementation process, the present invention makes full use of the interior space of the ceiling lamp. In order to accommodate the top plate, a first tank is formed, so that the ceiling lamp can fit on the wall when it is installed, matched with the shape of the first tank will form another tank, that is the second tank, in the present invention. The power supply module, the control board and other parts are installed in the second tank, which effectively utilizes the space of the part, thus making the arrangement of the internal parts of the ceiling lamp more compact and the overall structure smaller.

Preferably, the air guide shell is configured on the fan, a certain number of air guide plate modules are formed uniformly around the inner wall of the air guide shell toward the axis of the air guide shell, the gaps between the air guide plate modules communicate with the air hole.

In the above-mentioned implementation process, the air guide plate module can conduct the air flow smoothly. Whether the air enters or exits from the air guide plate, it can realize the uniform input or output of the air flow, so as to reduce the noise caused by the air flow, and the filtering effect is better.

Preferably, the air guide plate modules comprise at least one first air guide plate and at least one second air guide plate, the extension length of the first air guide plate is larger than that of the second air guide plate, and the first air guide plates are arranged at equal intervals, the second air guide plate is configured between two adjacent first air guide plates.

In the above-mentioned implementation process, the first air guide plate guides most of the air flow, and then the second air guide plate carries out a uniform split, so as to achieve uniform air inlet or uniform air outlet.

Preferably, a through hole connected with the second accommodation cavity is formed on the first air guide plate along the direction parallel to the axial direction of the wind guide shell.

In the above-mentioned implementation process, in order to achieve high efficiency of air inlet and outlet and improve the filtration efficiency, there is a certain interval between the air outlet and the air inlet, the illuminant board, the power supply module and the control main board are separated by fans, and the through holes on the first air guide plate can be used for connecting wires to pass through, so that the illuminant board, the power supply module and the control board can realize electrical connection, by adopting the structure, the electrical connection between the separated parts is realized under the condition of ensuring sufficient air tightness, and it also implements the technical effect of compact structure, balanced lighting function and air purification function and high efficiency through reasonable and ingenious parts position arrangement in the present invention.

Preferably, the filter screen module comprise a filter screen frame in a cylindrical shape and a filter screen installed on the inner bottom of the filter frame, a holding tank is formed on the filter screen frame, The outer wall of the upper edge of the filter frame is connected with the inner wall of the air passage by screw thread.

Preferably, the filter screen module also comprise a baffle plate arranged under the filter frame and a connecting rod which connecting the baffle plate and the bottom surface of the filter frame.

In the above-mentioned implementation process, on the one hand, the baffle design can block the filter frame and promote the overall beauty. on the other hand, it effectively limits the size of the air hole and makes the air flow more orderly. For example, when the air flow enters the ceiling lamp from the air passage, the external air needs to enter from the baffle and the edge of the air passage entrance, which effectively controls the air inlet volume and the direction of the air inlet. When the air is discharged from the air duct towards the baffle, the baffle plays the role of diversion, and evenly distributes the filtered air everywhere.

Preferably, a first member consist of the ceiling shell and the main shell, a second member consist of the filter screen module and the air guide shell, the first member is configured detachably on the second member.

In the above-mentioned implementation process, the lampshade and the main shell constitute the first component, which is the lamp main body, while the wind guide shell and the filter screen constitute the second component, which constitutes the purification main body. In the specific use, users can change different lamp body and purification body according to their own preferences, so as to achieve a variety of collocation. When the lamp body fails, the lamp body can be disassembled separately for maintenance, and the whole ceiling lamp does not need to be disassembled, which further improves the flexibility and diversity of use.

In comparison with the prior art, the beneficial effect of the invention is that the present invention realizes a good balance between the ceiling lamp lighting function and the air purification function by ingeniously arranging the position relationship between the filter screen module and the lamp body, and the position relationship between the air duct, the fan and the air hole, so that the lighting function and the filter purification function can achieve the maximum benefit coexistence. Under the premise of not affecting the normal lighting function, it can ensure the maximum filtration and purification effect.

Secondly, the present invention makes full use of the internal space to realize the overall compact structure. The second tank is used to place the power supply module and the control board, and the first air guide plate is penetrated to form a through hole for conducting wires to pass through. The above-mentioned technical improvements are all through reasonable and ingenious parts position arrangement, so as to achieve the technical effect of compact structure, balanced lighting function and air purification function and high efficiency.

Thirdly, the purification performance of the present invention is improved. Compared with the technical scheme of side air inlet and side air outlet, the air inlet and outlet process of this scheme have less mutual influence, and the air flow transmission is more stable, so as to improve the purification efficiency.

Fourthly, the present invention is convenient for assembly and maintenance. The electric connection structure adopts the way of rotary clamping, so it is not necessary to connect the power supply before installation. The filter screen module can be threaded in the air passage, so it is very convenient to replace or clean the filter screen in the later stage.

BRIEF DESCRIPTION OF THE DRAWINGS

In order to more clearly illustrate the embodiments of the present invention or the technical solutions in the prior art, the drawings used in the description of the embodiments of the present invention or the prior art will be briefly introduced below. Obviously, the drawings described in the following are only a part of the embodiments of the present invention. For the ordinary skills in the art, other drawings can be obtained based on these drawings without paying creative labor.

DETAILED DESCRIPTION OF THE PREFERRED EMBODIMENT

Figure 1:
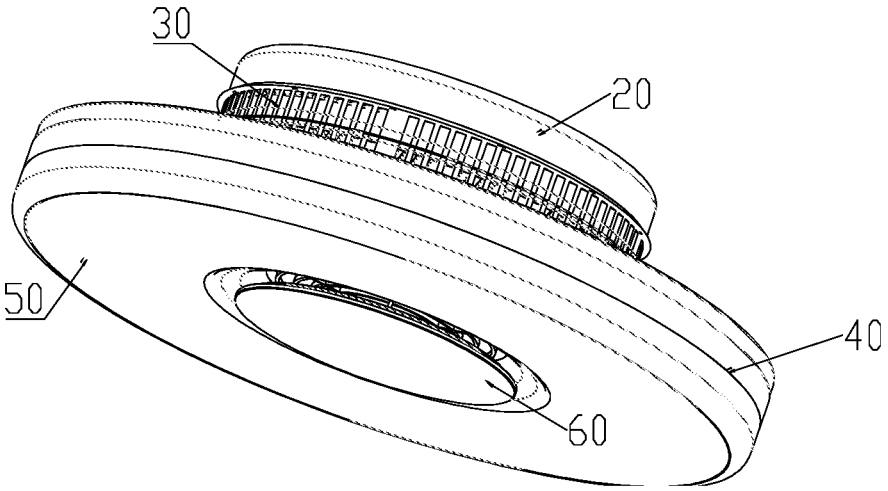
FIG. 1 is an perspective view of the overall structure of the ceiling lamp according to an embodiment of the present invention.
Figure 2:
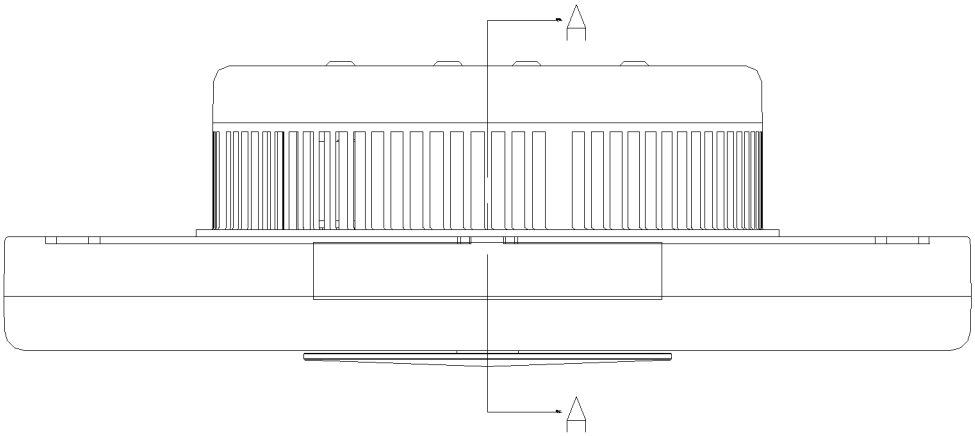
FIG. 2 is a perspective view of the side structure of the ceiling lamp according to an embodiment of the present invention.
Figure 3:
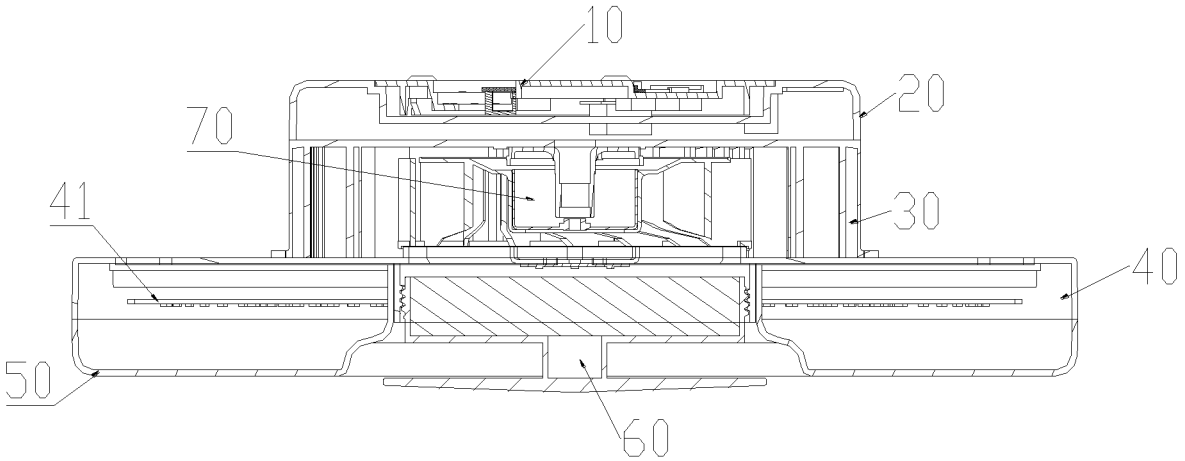
FIG. 3 is a perspective view of a profile structure of the ceiling lamp according to an embodiment of the present invention.
Figure 4:
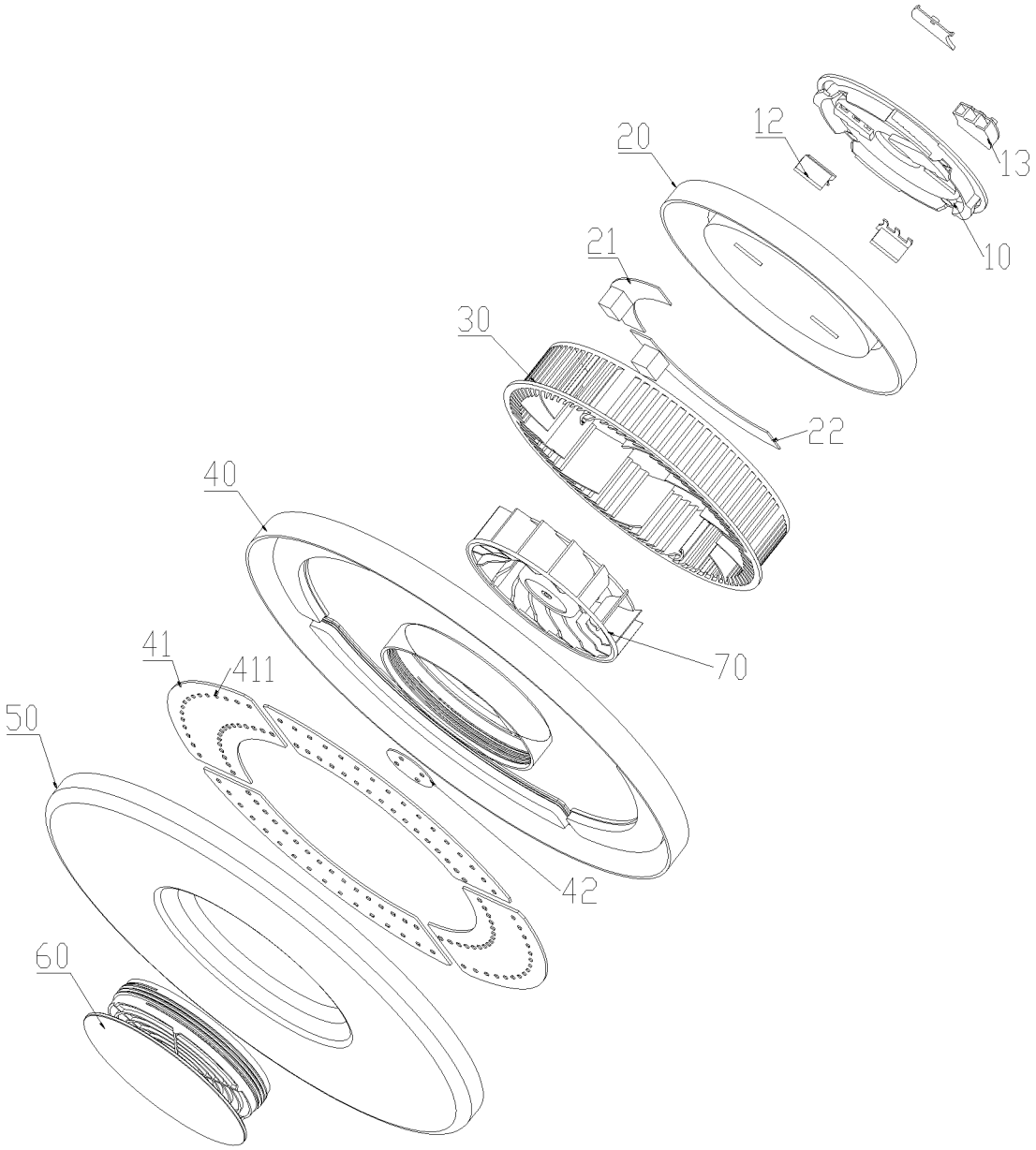
FIG. 4 is an exploded view of the ceiling lamp according to an embodiment of the present invention.

Hereinafter, a number of embodiments of the present invention will be disclosed in drawings. For clear description, many practical details will be described in the following description. However, it should be understood that these practical details should not be used to limit the present invention. In other words, in some embodiments of the present invention, these practical details are unnecessary. In addition, in order to simplify the drawings, some conventionally used structures and components will be shown in simple schematic ways in the drawings It should be noted that all directional indications (such as up, down, left, right, front, back . . . ) in the embodiments of the present invention are only used to explain the relationship between the components in a particular posture (as shown in the accompanying drawings). If the relative positional relationship, movement situation, etc. change, the directional indication will change accordingly.

In addition, in the present invention, the descriptions related to first, second, etc. are only used for descriptive purposes, and do not specifically refer to the order or sequence, nor are they used to limit the present invention. They are only used to distinguish between the same technical terms describe only the components or operations, but cannot be understood as indicating or implying their relative importance or implicitly indicating the number of the indicated technical features. Therefore, the features defined with "first" and "second" may explicitly or implicitly include at least one of the features. In addition, the technical solutions between the various embodiments can be combined with each other, but they must be based on what can be achieved by those of ordinary skill in the art. When the combination of technical solutions is contradictory or cannot be achieved, it should be considered that such a combination of technical solutions does not exist and is not within the protection scope of the present invention.

In order to further understand the content, features and effects of the present invention, the following embodiments are given as examples, and detailed descriptions are as follows with accompanying drawings.

The existing ceiling lamp with the function of air purification can not achieve a good balance in the position distribution between the air purification and the main body of the ceiling lamp, it usually ignore the air filtration efficiency in order to ensure enough space for lighting part, or make the whole ceiling lamp look thick and bulky in order to combine the air filtration efficiency and enough space for lighting part. In order to make the whole structure more compact, some ceiling lamps use the way of side air intake and side air supply to reduce the whole size of the ceiling lamp, while this way is affects the air inlet efficiency and air outlet efficiency, the uniformity of air inlet and air outlet is also affected, and the overall effect of air purification is ordinary.

Specifically, please refer to FIGS. 1~14, the present invention provides a ceiling lamp, which comprises a top plate 10, a ceiling shell 20, an air guide shell 30, a main shell 40 and a lampshade 50 which are fixedly connected from top to bottom.

Specifically, a first accommodation cavity is formed between the ceiling shell 20 and the air guide shell 30, a power supply module 21 and a control board 22 is configured in the first accommodation cavity.

Specifically, the lampshade 50 is arranged on the main shell 40 to form a second accommodation cavity, a illuminant board 41 is configured in the second accommodation cavity.

A fan 70 is configured coaxially on the axis of the air guide shell 30, and the middle part of the lampshade 50 is recessed along its axial direction to form an air passage communicating with the fan 70, at least one air hole 31 is formed uniformly on the air guide shell 30.

A filter screen module 60 is configured detachably in the air passage.

The flow direction of the external air is from the filter module to the fan and then discharged from the air hole 31, or from the air hole 31 to the fan 70 and then discharged through the filter screen.

Figure 5:
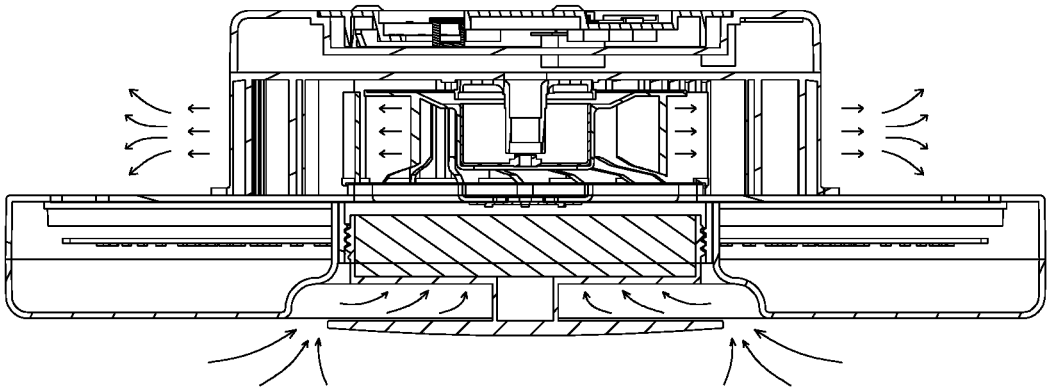
FIG. 5 is a perspective view of the air flow direction according to an embodiment of the present invention.
Figure 6:
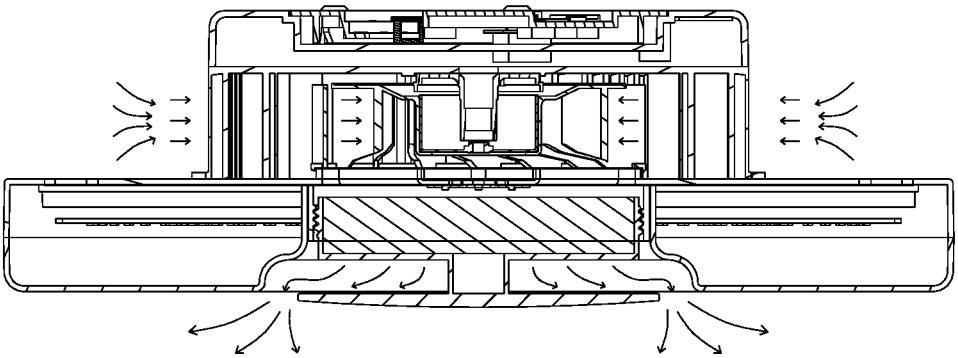
FIG. 6 is a perspective view of the air flow direction according to an embodiment of the present invention.
Figure 7:
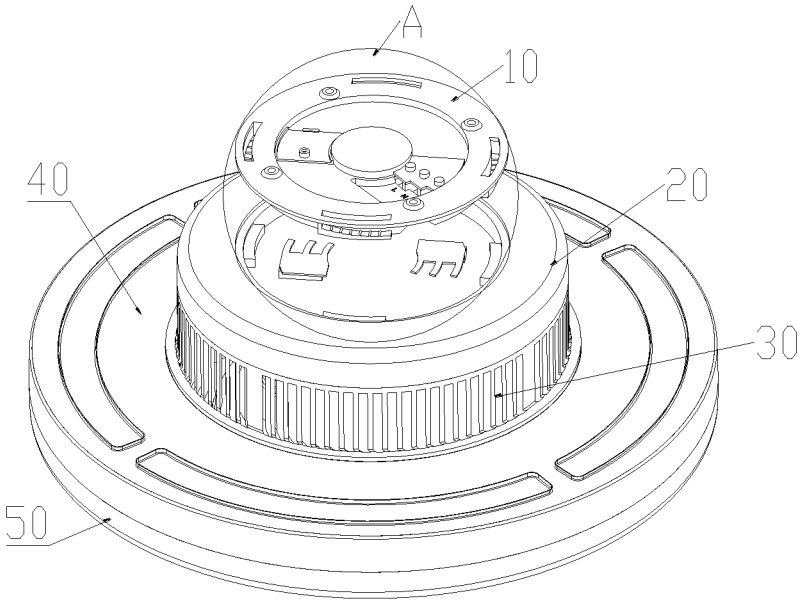
FIG. 7 is a perspective view of a partial structure of the ceiling lamp according to an embodiment of the present invention.
Figure 8:
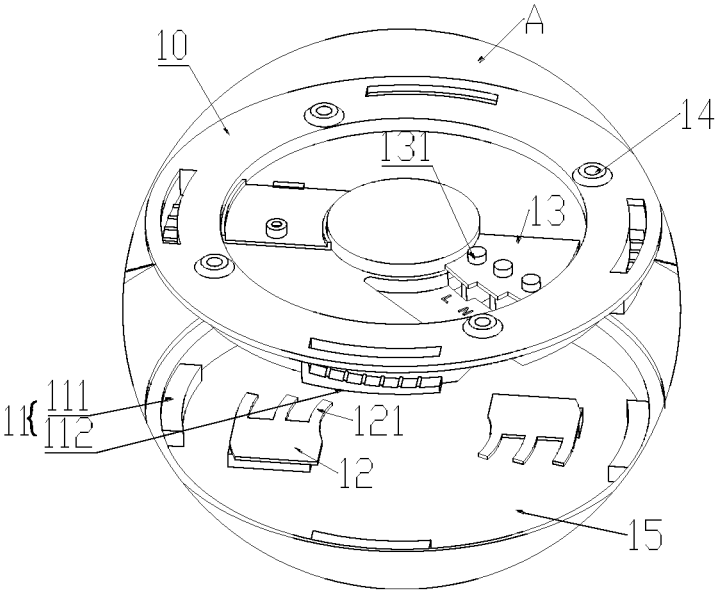
FIG. 8 is an enlarged view of the structure of part A in FIG. 7.
Figure 9:
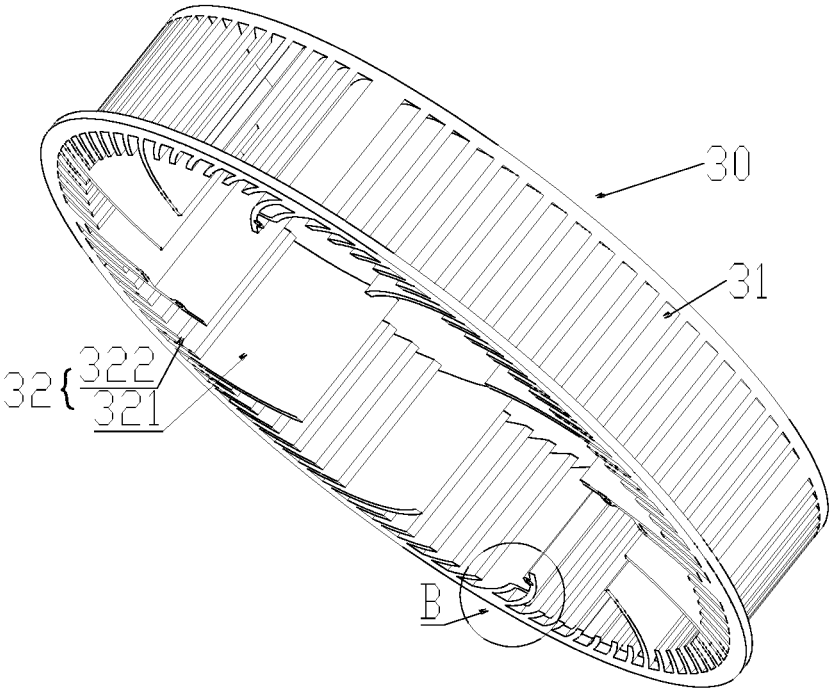
FIG. 9 is a perspective view of an air guide shell according to an embodiment of the present invention.
Figure 10:
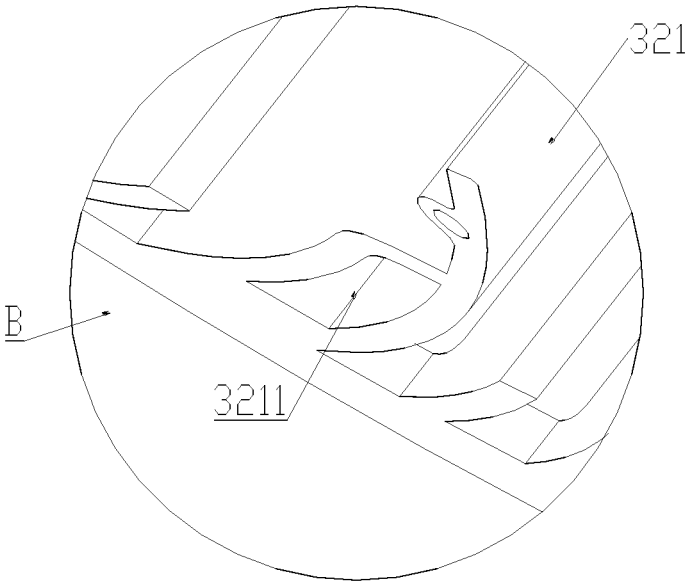
FIG. 10 is an enlarged view of the structure of part B in FIG. 9.
Figure 11:
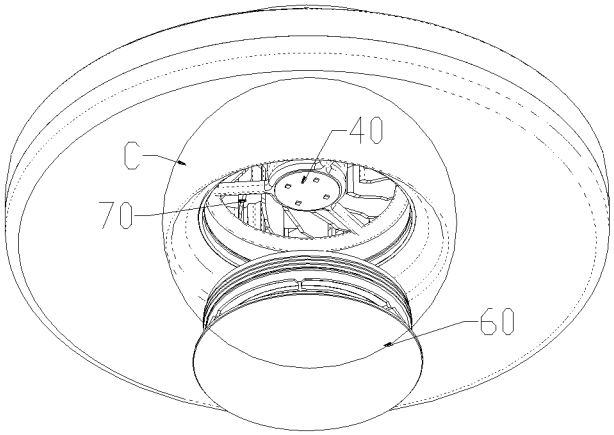
FIG. 11 is a perspective view of a partial structure of the ceiling lamp according to an embodiment of the present invention.
Figure 12:
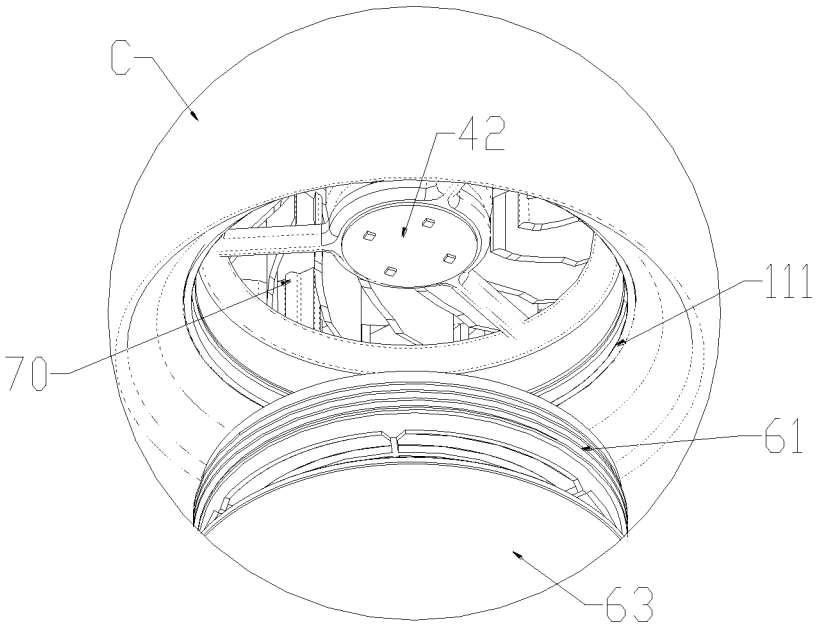
FIG. 12 is an enlarged view of the structure of part C in FIG. 11.
Figure 13:
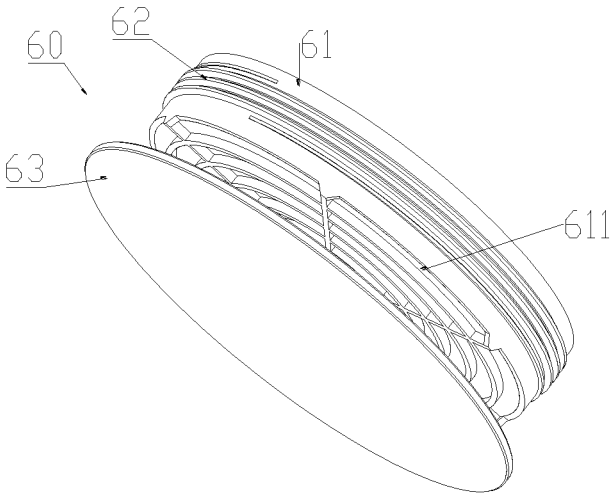
FIG. 13 is a perspective view of a filter screen module according to an embodiment of the present invention.
Figure 14:
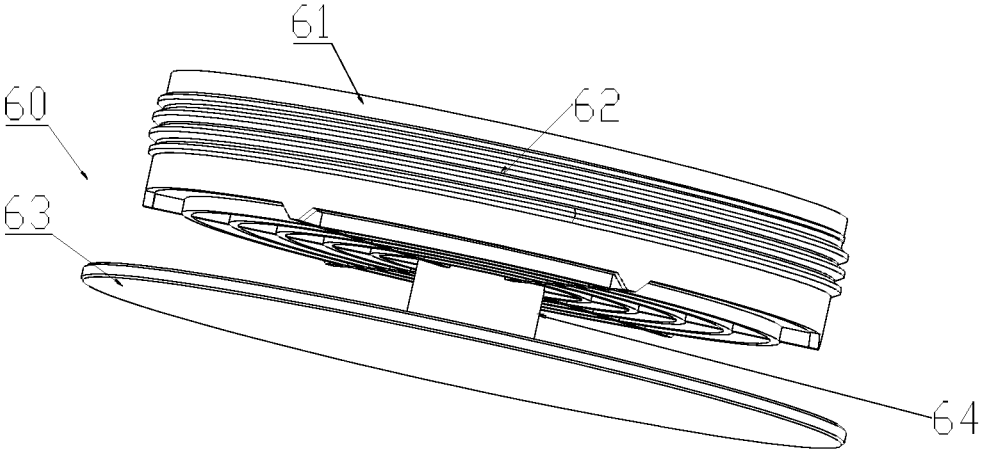
FIG. 14 is a perspective view of a filter screen module according to an embodiment of the present invention.

Specifically, please refer to FIG. 5~6, There are two ways for the external air flow to enter the ceiling lamp. Please refer to FIG. 5. The external air flow is guided by the air passage under the drainage of the fan 70, and reaches the fan 70 through the filter screen module 60. The fan 70 discharges the air flow out of the lamp along the air guide shell 30, so as to realize the air inlet from the lower side and the air outlet from the upper side wall. The direction of air flow in FIG. 6 is opposite to that in FIG. 5.

In the above-mentioned solution, the present invention provides a ceiling lamp, which has both lighting function and purification function, the filter screen module 60, which play the main purification role is arranged in the middle, the filter screen module 60 can evenly inhale air from multiple angle, and then purify and discharge it, which purification coverage is wide and uniform. The air inlet and the air outlet are arranged in layers and connected with each other through the fan 70, which maximizes the air intake and air outlet, and improve filtration efficiency. The lampshade 50 sinks in to form an air passage, the filter screen module 60 is arranged in the air passage, no matter how the air flow direction is, air can enter the ceiling lamp or discharge out of the lamp only through the filtering effect of the filter screen module 60. It can be seen that the present invention orderly and compactly arranges the filter screen module 60 and other lighting related parts of the ceiling lamp through reasonable location, so as to achieve the maximum benefit coexistence between the lighting function and the filtering and purification function, under the premise of not affecting the normal lighting function, it can ensure the maximum filtration and purification effect.

Specifically, the ceiling shell 20 is concave to form a first tank 15 for accommodating the top plate 10, a set of adaptive rotating buckle structure 11 is configured respectively in the inner wall of the first tank 15 and the circumference of the top plate 10, the ceiling shell 20 is rotationally clamped on the top plate 10 by the rotating buckle structure 15.

In the above-mentioned solution, the people can fix the top plate 10 on the ceiling or wall, then misplace the first block 12 with the clamping tank 13, insert the first tank 15 into the top plate 10, insert the top plate 10 into the first tank 15, and then rotate in a directional direction, and the rotating buckle structure 11 completes the fixed connection in the process of rotation.

Specifically, a set of electric clamping structure is configured on the ceiling shell 20 and the top plate, 10 the electric clamping structure comprises a first clamping block 12 extended to form a plurality of arc-shaped clamping edges 121 and a clamping tank matched with the clamping edge 121, a set of adaptive conductive part is configured on the clamping edge 121 and clamping tank 13.

The clamping edge 121 is clamped into the clamping tank 13 and the top plate is electrically connected with the ceiling shell 20 when the rotating buckle structure 11 is clamped in place.

In the above-mentioned solution, the rotating buckle structure 11 completes the fixed connection in the rotation process, at the same time, the clamping edge 121 on the first clamping block 12 is also clamped into the clamping tank 13 in the rotation process, and the conductive part on the clamping edge 121 contacts with the conductive part in the clamping tank 13 to complete the electrical connection.

In the above-mentioned solution, not only the ceiling lamp is fixed, but also its electrical conduction is completed by rotating buckle structure 11, there is no need to connect other wires, so the installation is convenient and fast, and the subsequent disassembly and replacement is also very convenient, which improves the user experience, in addition, the rotating buckle structure 11 is set at the periphery, while the electric clamping structure is set at the inner circumference, the two cooperate with each other, which makes the overall connection structure more stable and firm, the distribution of stress points is uniform, and the safety performance after connection is higher.

Specifically, a second tank is formed around the first tank 15 on the side of the ceiling shell 20 facing away from the top plate 10, the second tank is annular, the power supply module 21 and the control board 22 is configured in the second tank.

In the above-mentioned solution, the present invention makes full use of the interior space of the ceiling lamp. In order to accommodate the top plate 10, a first tank 15 is formed, so that the ceiling lamp can fit on the wall when it is installed, matched with the shape of the first tank 15 will form another tank, that is the second tank, in the present invention. The power supply module 21, the control board 22 and other parts are installed in the second tank, which effectively utilizes the space of the part, thus making the arrangement of the internal parts of the ceiling lamp more compact and the overall structure smaller.

Specifically, A plurality of fixed through holes 14 are formed on the top plate 10.

In the above-mentioned solution, the people fix the top plate on the wall through the fixing through hole 14 by fixing screws or other fastening devices.

Specifically, a wiring terminal 131 is arranged on the side of the top plate 10 facing away from the ceiling shell 20, and the wiring terminal 131 is electrically connected with an electric clamping structure arranged on the top plate 10. The wiring terminal 131 is connected with an external conducting wire, which only needs to be connected once during the installation, and the subsequent ceiling lamp does not need to be connected again during the installation, so as to improve the efficiency.

Further, the wiring terminal 131 includes a zero wire terminal, a fire wire terminal and a ground wire terminal.

Specifically, the air guide shell 30 is cover on the fan 70, a certain number of air guide plate module 32 are uniformly surrounded by the inner wall of the air guide shell 30 toward the axis of the air guide shell 30, the gap between the air guide plate module 32 is connected with the air hole.

In the above-mentioned solution, the air guide plate module 32 can conduct the air flow smoothly. Whether the air enters or exits from the air guide plate, it can realize the uniform input or output of the air flow, so as to reduce the noise caused by the air flow, and the filtering effect is better.

Specifically, the air guide plate module 32 comprises at least one first air guide plate 321 and second air guide plate 322, the extension length of the first air guide plate 321 is larger than that of the second air guide plate 322, and the first air guide plates 321 are arranged at equal intervals, the second air guide plate 322 is configured between two adjacent first air guide plates.

In the above-mentioned solution, the first air guide plate 321 guides most of the air flow, and then the second air guide plate 322 carries out a uniform split, so as to achieve uniform air inlet or uniform air outlet.

Specifically, a through hole connected with the second accommodation cavity is formed on the first air guide plate 322 along the direction parallel to the axial direction of the air guide shell 30.

In the above-mentioned solution, in order to achieve high efficiency of air inlet and outlet and improve the filtration efficiency, there is a certain interval between the air outlet and the air inlet, the illuminant board 41, the power supply module 21 and the control board 22 are separated by fans 70, and the through holes 3211 on the first air guide plate 321 can be used for connecting wires to pass through, so that the illuminant board 41, the power supply module 21 and the control board 22 can realize electrical connection, by adopting the structure, the electrical connection between the separated parts is realized under the condition of ensuring sufficient air tightness, and it also implements the technical effect of compact structure, balanced lighting function and air purification function and high efficiency through reasonable and ingenious parts position arrangement in the present invention.

Specifically, the filter screen module 60 comprise a filter screen frame 61 in a cylindrical shape and a filter screen installed on the inner bottom of the filter screen frame 61, a holding tank is formed on the filter screen frame, The outer wall of the upper edge of the filter frame is connected with the inner wall of the air passage by screw thread.

Specifically, a plurality of ventilation holes 611 are formed at the bottom of the filter screen frame 61; The ventilation hole 611 at the bottom of the filter screen frame 61 can be used for air flow, and the overall structure of the bracket can be used for placing filter accessories such as the filter screen.

Specifically, the filter screen module 60 also comprise a baffle plate 63 arranged under the filter screen frame 61 and a connecting rod which connecting the baffle plate 63 and the bottom surface of the filter screen frame 61.

In the above-mentioned solution, on the one hand, the design of the baffle plate 63 can block the filter screen frame 61 and promote the overall beauty, on the other hand, it effectively limits the size of the air hole and makes the air flow more orderly. For example, when the air flow enters the ceiling lamp from the air passage, the external air needs to enter from the baffle plate 63 and the edge of the air passage entrance, which effectively controls the air inlet volume and the direction of the air inlet. When the air is discharged from the air duct towards the baffle plate 63, the baffle plate 63 plays the role of diversion, and evenly distributes the filtered air everywhere.

Specifically, a second lamp 42 is arranged between the fan 70 and the filter screen module 60.

Further, the filter screen is coated with bacteriostatic coating.

Further, the antibacterial coatings include titanium dioxide and nanosilver.

Further, the second lamp 42 is a common illumination lamp such as a UV lamp.

In the above-mentioned solution, Under the illumination of the lamp body, titanium dioxide as a photocatalyst reacts to produce a strong catalytic degradation function, which can effectively degrade the toxic and harmful gases in the air, decompose and harmless the toxins released by bacteria or fungi, and also has the functions of deodorization, anti pollution, air purification, etc.; However, nanosilver has broad-spectrum antibacterial function and can effectively inhibit most bacteria.

Figure 15:
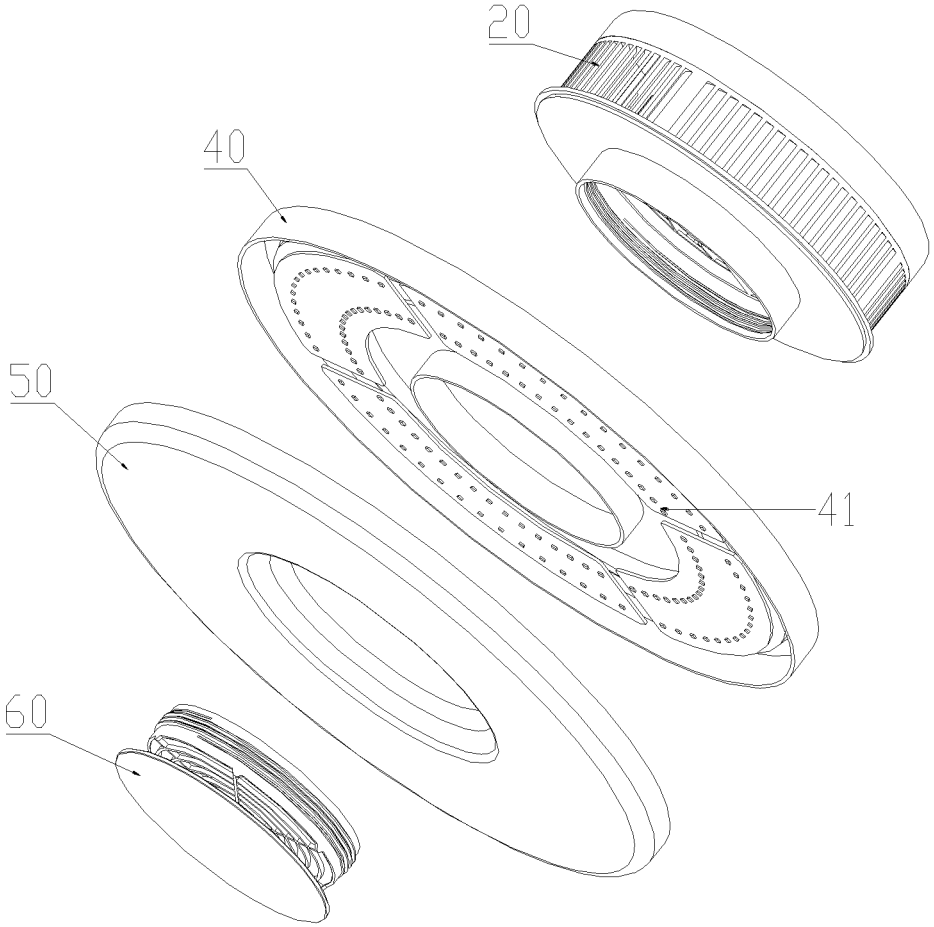
FIG. 15 is an exploded view of a partial structure of the ceiling lamp according to an embodiment of the present invention.

Specifically, please refer to FIG. 15, a first member consists of the lampshade 50 and the main shell 40, a second member consist of the filter screen module 60 and the air guide shell 30, the first member is configured detachably on the second member.

In the above-mentioned solution, the lampshade 50 and the main shell 40 constitute the first component, which is the lamp main body, while the air guide shell 30 and the filter screen module 60 constitute the second component, which constitutes the purification main body. In the specific use, users can change different lamp body and purification body according to their own preferences, so as to achieve a variety of collocation. When the lamp body fails, the lamp body can be disassembled separately for maintenance, and the whole ceiling lamp does not need to be disassembled, which further improves the flexibility and diversity of use.

Further, in actual disassembly, the filter screen module 60 is loosened and disassembled, and then the first member and the bottom end of the air guide shell 30 are separated, so that the first member, namely the lamp body, can be separated.

Further, a connecting socket and a fastening screw can be arranged between the top surface of the first member and the bottom surface of the air guide shell 30 to realize fixed connection and electrical connection.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A ceiling lamp, comprising:

a top plate;

a ceiling shell;

an air guide shell having at least one air hole, wherein a first accommodation cavity is formed between the ceiling shell and the air guide shell;

a main shell;

a lampshade fixedly connected from top to bottom, and being arranged on the main shell to form a second accommodation cavity;

a power supply module;

a control board, the power supply module and the control board being configured in the first accommodation cavity, an illuminant board configured in the second accommodation cavity;

a fan configured coaxially on an axis of the air guide shell, a middle part of the lampshade being recessed along its axial direction to form an air passage communicating with the fan; and a filter screen module configured detachably in the air passage, a flow direction of the external air is from the filter module to the fan and then discharged from the air hole, or from the air hole to the fan and then discharged through the filter module, wherein the ceiling shell is concaved to form a first tank for accommodating the top plate, a set of adaptive rotating buckle structure is configured respectively in the inner wall of the first tank and the circumference of the top plate, the ceiling shell is rotationally clamped to the top plate by the rotating buckle structure.

2. A ceiling lamp according to claim 1, wherein a set of electric clamping structure is configured on the ceiling shell and the top plate, the electric clamping structure comprises a first clamping block extended to form a plurality of arc-shaped clamping edges and a clamping tank matched with the clamping edge, a set of adaptive conductive part is configured on the clamping edge and clamping tank, the clamping edge is clamped into the clamping tank and the top plate is electrically connected with the fixed plate when the rotating buckle structure is clamped in place.

3. A ceiling lamp according to claim 1, wherein a second tank is formed around the first tank on the side of the ceiling shell facing away from the top plate, the second tank is annular, the power supply module and the control board is configured in the second tank.

4. A ceiling lamp according to claim 1, wherein the filter screen module comprises a filter screen frame in a cylindrical shape and a filter screen installed on an inner bottom of the filter frame, wherein a holding tank is formed on the filter screen frame.

5. A ceiling lamp according to claim 4, wherein the filter screen module also comprise a baffle plate arranged under the filter frame and a connecting rod which connecting the baffle plate and the bottom surface of the filter frame.

6. A ceiling lamp, comprising:

a top plate;

a ceiling shell;

an air guide shell having at least one air hole, wherein a first accommodation cavity is formed between the ceiling shell and the air guide shell;

a main shell;

a lampshade fixedly connected from top to bottom, and being arranged on the main shell to form a second accommodation cavity;

a power supply module;

a control board, the power supply module and the control board being configured in the first accommodation cavity, an illuminant board configured in the second accommodation cavity;

a fan configured coaxially on an axis of the air guide shell, a middle part of the lampshade being recessed along its axial direction to form an air passage communicating with the fan; and a filter screen module configured detachably in the air passage, a flow direction of the external air is from the filter module to the fan and then discharged from the air hole, or from the air hole to the fan and then discharged through the filter module, wherein the air guide shell is configured on the fan, a certain number of air guide plate modules are formed uniformly around the inner wall of the air guide shell toward the axis of the air guide shell, the gaps between the air guide plate modules communicate with the air hole.

7. A ceiling lamp according to claim 6, wherein the air guide plate modules comprise at least one first air guide plate and at least one second air guide plate, the extension length of the first air guide plate is larger than that of the second air guide plate, and the first air guide plates are arranged at equal intervals, the second air guide plate is configured between two adjacent first air guide plates.

8. A ceiling lamp, comprising:

a top plate;

a ceiling shell;

an air guide shell having at least one air hole, wherein a first accommodation cavity is formed between the ceiling shell and the air guide shell;

a main shell;

a lampshade fixedly connected from top to bottom, and being arranged on the main shell to form a second accommodation cavity;

a power supply module;

a control board, the power supply module and the control board being configured in the first accommodation cavity, an illuminant board configured in the second accommodation cavity;

a fan configured coaxially on an axis of the air guide shell, a middle part of the lampshade being recessed along its axial direction to form an air passage communicating with the fan; and a filter screen module configured detachably in the air passage, a flow direction of the external air is from the filter module to the fan and then discharged from the air hole, or from the air hole to the fan and then discharged through the filter module, wherein a first member consists of the lampshade and the main shell, a second member consist of the filter screen module and the air guide shell, the first member is configured detachably on the second member.

* * * * *